US007845623B2

(12) United States Patent
Dopke et al.

(10) Patent No.: US 7,845,623 B2
(45) Date of Patent: Dec. 7, 2010

(54) INTEGRATED AIR INTAKE AND PRIMER FOR INTERNAL COMBUSTION ENGINE

(75) Inventors: Russell J. Dopke, Elkhart Lake, WI (US); Benji J. Bink, St. Cloud, WI (US); Dale D. Snyder, Oshkosh, WI (US)

(73) Assignee: Kohler Co., Kohler, WI (US)

( * ) Notice: Subject to any disclaimer, the term of this patent is extended or adjusted under 35 U.S.C. 154(b) by 318 days.

(21) Appl. No.: 12/018,001

(22) Filed: Jan. 22, 2008

(65) Prior Publication Data

US 2009/0184433 A1 Jul. 23, 2009

(51) Int. Cl.
*F02M 17/34* (2006.01)

(52) U.S. Cl. ..... 261/35; 55/DIG. 28; 123/198 E; 261/DIG. 8

(58) Field of Classification Search ..... 261/35, 261/69.1, DIG. 8, DIG. 68, DIG. 73; 123/179.11, 123/198 E, 184.47, 184.48, 184.49; 55/DIG. 28
See application file for complete search history.

(56) References Cited

U.S. PATENT DOCUMENTS

| | | | | | |
|---|---|---|---|---|---|
| 1,300,749 | A | * | 4/1919 | Longest | 123/179.9 |
| 2,078,250 | A | * | 4/1937 | Hurlburt | 261/88 |
| 3,323,293 | A | * | 6/1967 | Santi | 55/385.1 |
| 4,211,198 | A | * | 7/1980 | Thomas, Jr. | 123/523 |
| 4,233,043 | A | | 11/1980 | Catterson | |
| 4,294,779 | A | * | 10/1981 | Alape | 261/35 |
| 4,447,370 | A | * | 5/1984 | Kobayashi et al. | 261/35 |
| 4,457,271 | A | * | 7/1984 | Fitch | 123/179.12 |
| 4,508,068 | A | * | 4/1985 | Tuggle et al. | 123/179.11 |
| 4,944,897 | A | * | 7/1990 | Andreasson | 261/35 |
| 5,429,776 | A | * | 7/1995 | Edlund | 261/35 |
| 5,711,901 | A | | 1/1998 | Berg et al. | |
| 5,813,384 | A | | 9/1998 | Lavender et al. | |

(Continued)

FOREIGN PATENT DOCUMENTS

JP 58-10139 A * 1/1983 ..... 261/DIG. 8

(Continued)

OTHER PUBLICATIONS

Carburetor Information—Zenith; http://php.iupui.edu/~harrold/Gravely/carb; 2006; 5 pages.

(Continued)

*Primary Examiner*—Richard L Chiesa
(74) *Attorney, Agent, or Firm*—Whyte Hirschboeck Dudek SC

(57) ABSTRACT

An air intake component and assembly, as well as an associated carburetor assembly and related method of assembly, are disclosed. In at least some embodiments, the intake component includes a surface capable of being coupled at least indirectly to a carburetor assembly, where the surface includes first and second orifices, a first channel capable of communicating engine intake air from a first location to the first orifice of the surface, and a second channel by which at least one of the first location and a second location is connected to the second orifice. The second channel is capable of communicating at least one of a primer air pressure pulse from the at least one location to the second orifice and fuel fumes from the second orifice to the at least one location. In at least some further embodiments, the intake component can be fitted with any of several interchangeable covers.

27 Claims, 5 Drawing Sheets

U.S. PATENT DOCUMENTS

| | | | | |
|---|---|---|---|---|
| 5,988,602 | A * | 11/1999 | Yokoyama et al. | 261/35 |
| 6,092,793 | A * | 7/2000 | Yanagii | 261/35 |
| 6,142,454 | A * | 11/2000 | Aronsson et al. | 261/35 |
| 6,328,288 | B1 * | 12/2001 | Gerhardy | 261/35 |
| 6,427,364 | B1 | 8/2002 | Heismann et al. | |
| 6,446,939 | B1 | 9/2002 | Hoppe et al. | |
| 6,481,699 | B1 * | 11/2002 | Aihara et al. | 261/34.2 |
| 6,561,495 | B2 | 5/2003 | Woody | |
| 6,672,570 | B2 * | 1/2004 | Takano et al. | 261/39.2 |
| 6,705,272 | B2 | 3/2004 | Leipelt et al. | |
| 6,799,545 | B2 * | 10/2004 | Shaw | 123/179.11 |
| 7,021,263 | B1 | 4/2006 | Agnew et al. | |
| 7,152,852 | B1 * | 12/2006 | Habu et al. | 261/70 |
| 7,284,508 | B2 * | 10/2007 | Dopke et al. | 123/41.56 |
| 7,484,717 | B2 * | 2/2009 | Brazina | 261/34.2 |
| 2001/0005984 | A1 * | 7/2001 | Knodler et al. | 55/385.3 |
| 2002/0195726 | A1 * | 12/2002 | Galka et al. | 261/35 |
| 2003/0062633 | A1 * | 4/2003 | Woody | 261/37 |
| 2003/0160340 | A1 * | 8/2003 | Durr et al. | 261/16 |
| 2004/0040527 | A1 | 3/2004 | Murphy | |
| 2004/0188865 | A1 * | 9/2004 | Schmitz | 261/35 |
| 2005/0016474 | A1 | 1/2005 | Dopke et al. | |
| 2006/0243225 | A1 * | 11/2006 | Dopke et al. | 123/41.7 |

FOREIGN PATENT DOCUMENTS

| | | | | |
|---|---|---|---|---|
| JP | 1-187353 A * | 7/1989 | | 261/DIG. 8 |

OTHER PUBLICATIONS

Carburetor, from Wikipedia, the free encyclopedia; http://en.wikipedia.org; Nov. 13, 2006; 9 pages.

Holley the Heart & Soul of Performance; Carburetor, P/N 0-80450 & 0-80451; Installation, Tuning and Adjustment Manual; Holley Technical Support; Nov. 2002; 8 pages.

* cited by examiner

INTEGRATED AIR INTAKE AND PRIMER FOR INTERNAL COMBUSTION ENGINE

CROSS-REFERENCE TO RELATED APPLICATIONS

--

STATEMENT REGARDING FEDERALLY SPONSORED RESEARCH OR DEVELOPMENT

--

FIELD OF THE INVENTION

The present invention relates to internal combustion engines and, more particularly, to carburetors and associated air intake components employed in internal combustion engines.

BACKGROUND OF THE INVENTION

Small internal combustion engines are used in a wide variety of applications including for example, lawn mowers, lawn tractors, snow blowers and power machinery. Commonly, such internal combustion engines employ a carburetor to provide an appropriate air-fuel mixture to the combustion chamber of the internal combustion engine for generating power. Frequently, such carburetors have a fuel bowl that is coupled to a narrow throat/venturi region of the carburetor that serves as the air-fuel mixing chamber of the carburetor, and fuel enters the carburetor from the fuel bowl due at least in part to pressure differentials occurring within the venturi region.

Many such engines are used in seasonal machines (e.g., lawnmowers, snow blowers, tillers) or other machines that are not operated for long periods of time (e.g., chain saws), or that are operated under low-temperature conditions. When an engine is cold and/or has not be operated for a long period of time, it can be difficult to start the engine. Additionally, even after the engine has been started, the engine may not run smoothly until the engine warms up. To enhance the performance of such engines under these operational conditions, many engines include an engine priming mechanism by which, to achieve enhanced engine performance, the carburetor is provided with a richer air-fuel mixture.

To prime the carburetor, most carburetors in traditional schemes have a fitting that is pressed or screwed into the carburetor body. The fitting is further connected to passages leading to the fuel bowl attached to the carburetor, with the passages typically being cast or drilled into the carburetor body. Additionally, the primer fitting typically receives at its opposite end (opposite to the end that fits into the carburetor) a primer tube, which can either be directly connected to a primer bulb or lead to another location on the engine at which such a bulb or other priming device is located. More particularly, when a user presses the primer bulb, air is delivered from the priming bulb through the primer tube, the primer fitting and the passages within the carburetor body to the carburetor fuel bowl, and the resulting air pressure increase within the fuel bowl causes fuel to be driven into the carburetor venturi. Depending upon the embodiment, the priming bulb can provide a bowl vent (e.g., by including a small hole within the priming bulb) all by itself or in combination with additional passage(s).

Although adequate in many circumstances, such conventional priming mechanisms nevertheless are inadequate in some regards. In particular, such conventional priming mechanisms involving a primer fitting require assembly of the primer fitting to the carburetor body. As a result, the potential exists for the fitting to slip out of place or crack the carburetor body. Also, many conventional priming mechanisms are not well-suited for allowing engine operation under varying temperature conditions. For example, priming mechanisms utilized in engines that are designed for operation under warm (e.g., summer) conditions often are incompatible with optimal operation of the engines under cold (e.g., winter) conditions, since shielding that is often constructed around the carburetor of an engine to protect it from cold air and snow during operation under the latter conditions can obstruct access to the engine's priming mechanism.

For at least these reasons, therefore, it would be advantageous if an improved priming mechanism could be designed. More particularly, it would be advantageous if, in at least some embodiments, such an improved priming mechanism did not require or employ any separate primer fitting. Also, it would be advantageous if, in at least some embodiments, the priming mechanism was compatible with engine usage under various different temperature (or possibly other) operational conditions.

SUMMARY OF THE INVENTION

In at least some embodiments, the present invention relates to an air intake component. The air intake component includes a surface capable of being coupled at least indirectly to a carburetor assembly, where the surface includes first and second orifices, a first channel capable of communicating engine intake air from a first location to the first orifice of the surface, and a second channel by which at least one of the first location and a second location is connected to the second orifice. The second channel is capable of communicating at least one of a primer air pressure pulse from the at least one location to the second orifice and fuel fumes from the second orifice to the at least one location.

Further, in at least some embodiments, the present invention relates to a carburetor assembly. The carburetor assembly includes a carburetor wall defining an air-fuel mixing chamber, a fuel bowl, a passage linking the fuel bowl to the air-fuel mixing chamber, and an output port at a first end of the air-fuel mixing chamber, at which a mixture of air and fuel can be output. The carburetor assembly further includes a surface at a second end of the air-fuel mixing chamber, where the surface defines a first orifice that serves as an entry to the air-fuel mixing chamber by which engine intake air can enter the air-fuel mixing chamber. Also, the surface further defines a second orifice that is coupled to the fuel bowl by way of a further passage.

Additionally, in at least some embodiments, the present invention relates to an air intake assembly. The air intake assembly includes a first portion having a first surface, and a cover that is assembled to the first portion along a second surface. The first portion includes first and second channels linking a first region formed by the first portion and the cover to the first surface, and the first channel serves as a passage for engine intake air to be communicated to a carburetor, while the second channel serves to allow communication of at least one of a priming impulse and fuel vapors.

Further, in at least some embodiments, the present invention relates to a method of providing an air intake assembly. The method includes assembling an intake base in relation to a carburetor assembly, where the intake base includes first and second channels extending to first and second orifices along a surface of the intake base that interfaces at least indirectly the carburetor assembly. Upon the assembling of the intake base to the carburetor assembly, the first channel within the intake base is in communication with an air-fuel mixing chamber of the carburetor assembly by way of the first orifice and a second channel within the intake base is in communication with a fuel bowl of the carburetor assembly by way of the second orifice. Also, the method includes attaching a first cover to the intake base, wherein the first cover includes a priming bulb. Upon the attaching of the first cover to the intake base, the priming bulb is linked to the second channel so that, upon a compressing of the priming bulb, a primer air pressure pulse is supplied to the fuel bowl by way of the second channel and the second orifice.

DETAILED DESCRIPTION OF THE PREFERRED EMBODIMENT

Figure 1:
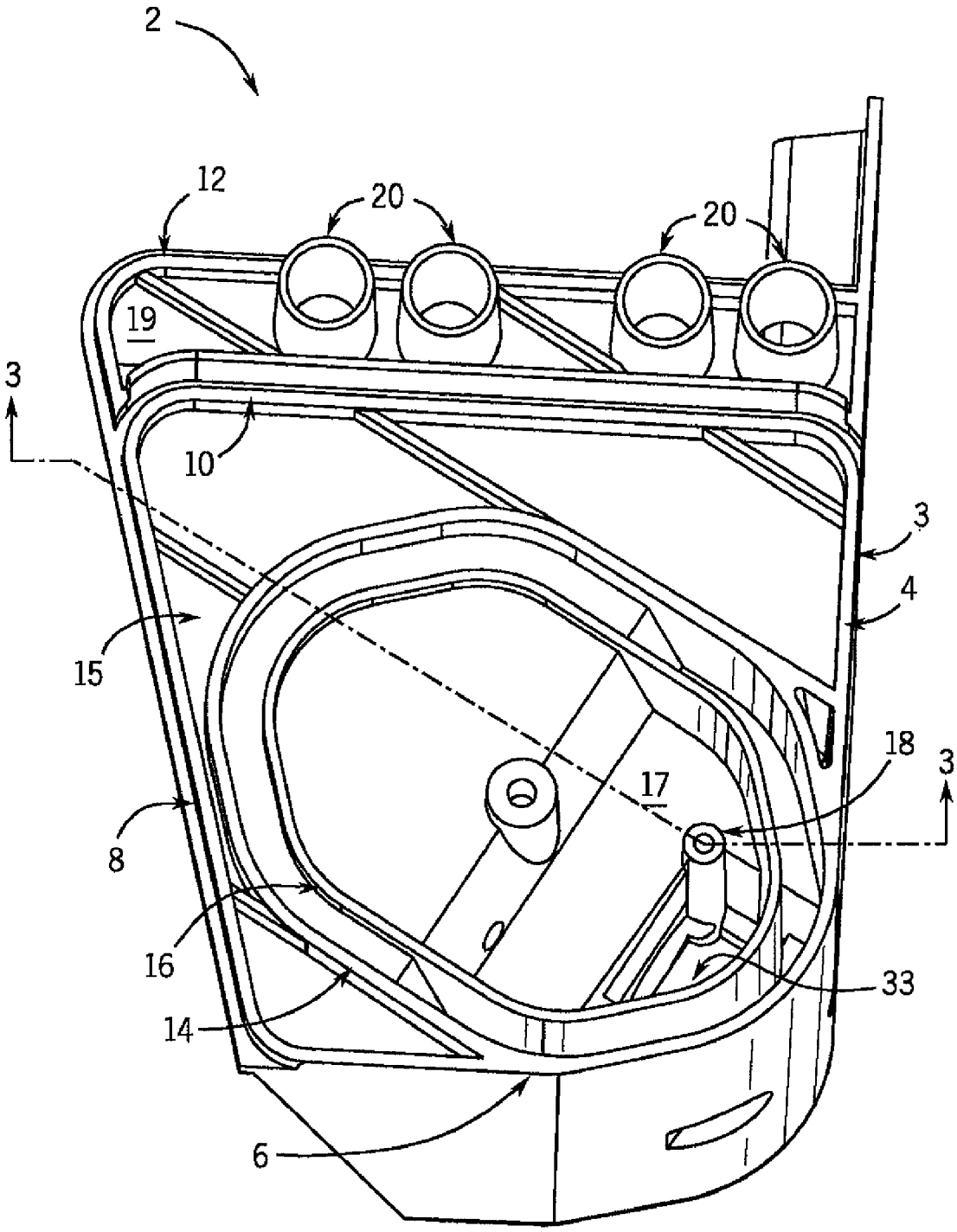
FIG. 1 is a perspective top view of an intake base in accordance with one embodiment of the present invention.
Figure 2:
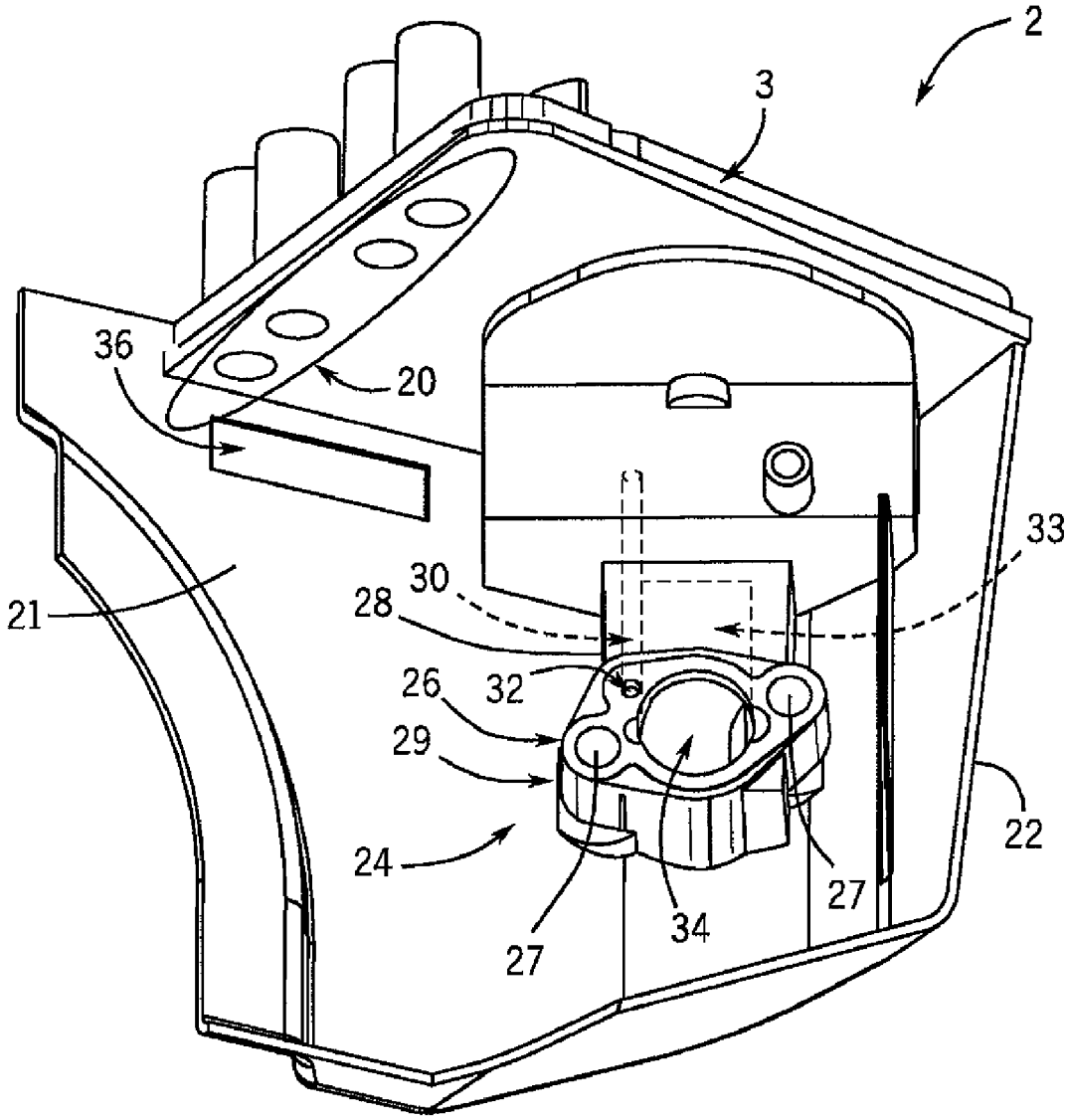
FIG. 2 is a perspective side view of the intake base of FIG. 1.
Figure 3:
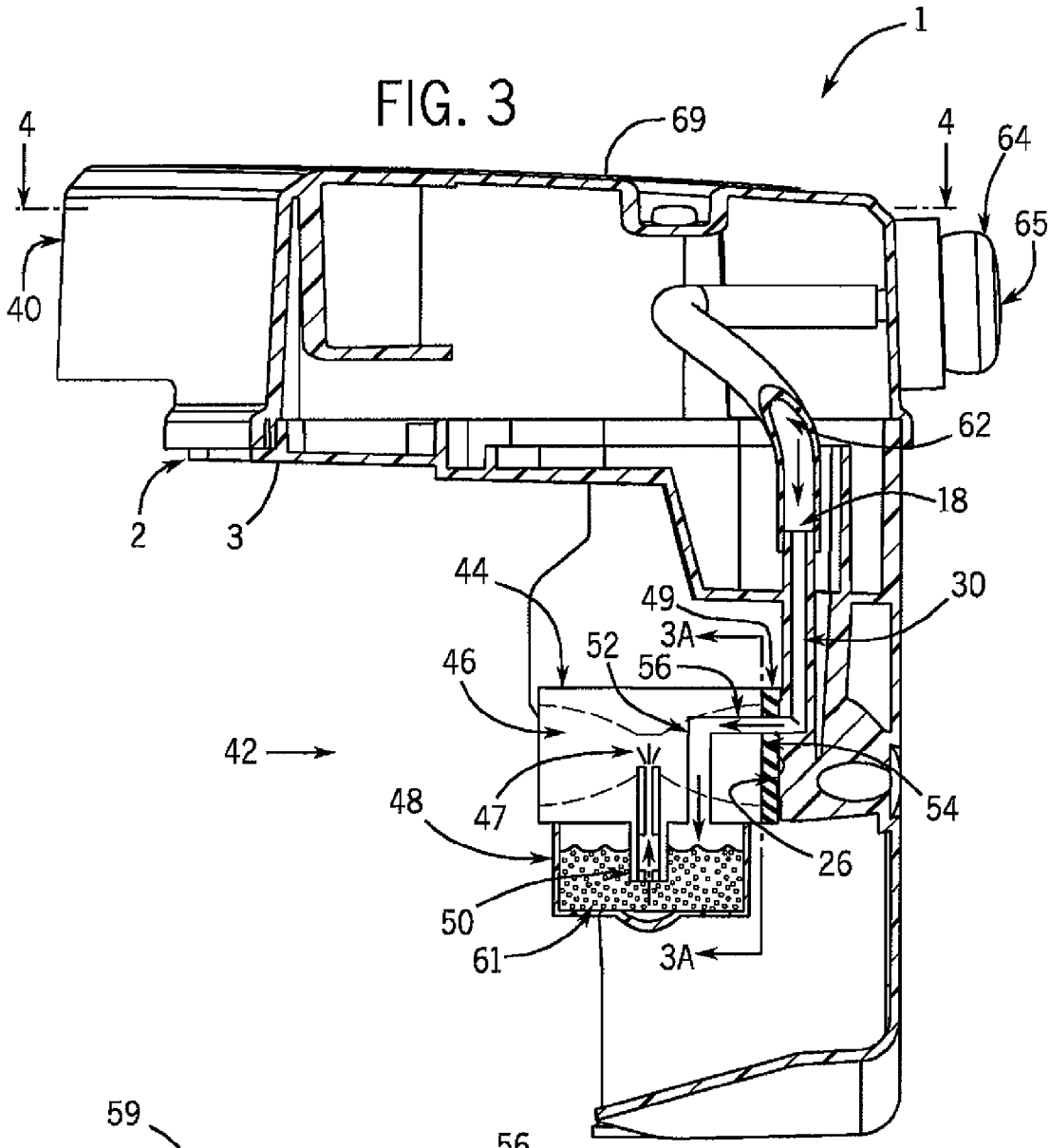
FIG. 3 is a side cross-sectional view of the intake base of FIG. 1 in combination with a carburetor assembly (shown in partial cross-section) and a winter intake cover in accordance with one embodiment of the present invention, the cross-section being taken (at least in terms of the intake base) along line 3-3 of FIG. 1.

Referring to FIGS. 1 and 2, an intake base 2 is shown that, in accordance with at least some embodiments of the present invention, forms a portion of an overall assembly that is used to provide air to a carburetor (see FIG. 3). As shown, the intake base 2 is formed from molded plastic and is molded to include an upper plate 3 as well as additional structures extending from the upper plate, primarily below the upper plate (see FIG. 2). The exact shape and material of the intake base 2 can vary depending upon the embodiment.

As shown particularly in FIG. 1, the upper plate 3 in the present embodiment has a generally trapezoidal shape. Additionally, the upper plate 3 has located thereon various structures that can be used in different types of engine configurations without replacing the carburetor. More particularly, the upper plate 3 includes first, second, third and fourth lips 4, 6, 8 and 12, respectively, that continuously extend around the periphery of the upper plate. In addition, a further, fifth lip 10 extends between the first and third lips 4 and 8 generally parallel to, and inwardly with respect to, the fourth lip 12. As will be described further below, the first, second, third and fourth lips 4, 6, 8 and 12 can be employed in conjunction with a summer intake cover to form a first sealable cavity region, while the first, second, third and fifth lips 4, 6, 8 and 10 can be employed in conjunction with a winter intake cover to form a second sealable cavity region. Although the present embodiment has the lips 4-12 as shown, in other embodiments the number and arrangement of lips can vary from that shown, as can the overall shape and size of the upper plate 3.

Additionally positioned along the upper plate 3 between the lips 4, 6, 8 and 10 are two concentric oval lips, namely, an outer lip 14 and an inner lip 16. Along at least a portion of its circumference, the outer lip 14 is formed by, and is merged with, certain of the lips 4-12 (particularly the lips 4 and 6). The inner lip 16 (particularly along about half of its circumference) defines an air filter cavity 17 that protrudes downwardly through the upper plate 3 farther into the intake base. The outer and inner lips 14, 16 also in particular are configured to interface an air filter (see FIG. 5) that can be placed upon the upper plate 3 depending upon its configuration. More particularly, while the inner lip 16 serves as a seating for the air filter, the outer lip 14 sealably engages the air filter to prevent any (or substantially any) air leakage between the air filter cavity 17 and the region above the air filter. That is, due to the lips 14 and 16, when such an air filter is placed upon the upper plate 3, the air filter cavity 17 beneath the air filter is separated from the region above the air filter by the air filter itself, such that unfiltered (e.g., dirty) incoming air must proceed through and be filtered by the air filter before proceeding into the air filter cavity 17.

In addition, the upper plate 3 also shows several tubes. Among these is a base tube 18 extending upward through the air filter cavity 17, which is described in further detail below. Additionally, the upper plate 3 includes four summer intake tubes 20 positioned between the lips 10 and 12, each of which extends through the plate. As will be discussed in further detail below, when a summer intake cover is positioned onto the intake base 2, unfiltered air enters a cavity region formed by the intake base and the summer intake cover by way of the tubes 20. Notwithstanding the intake tubes 20 shown in FIG. 1, the number and particular orientation(s) and spacing(s) of the intake tubes can vary depending upon the embodiment. For example, while in the present embodiment the summer intake tubes 20 are divided into two sets of two tubes each where the spacing between the two sets is larger than the spacing between the tubes of each respective set, in other embodiments the four or more tubes can be evenly spaced as well. Likewise, the particular characteristics of the base tube 18 can be varied from that shown depending upon the embodiment.

Referring to FIG. 2, a perspective side view of the intake base 2 shows additional features of the intake base in more detail, particularly certain features existing beneath the upper plate 3 by which the intake base is adapted to attach to the face of a carburetor (see FIG. 3). As shown, the intake base 2 in particular includes not only the upper plate 3 but also includes vertical walls 21 and 22 respectively extending downward from the edges of the upper plate 3 at which are formed the lips 4 and 6, respectively. Further, also extending downward from the upper plate 3 is a molded intake elbow 24. As shown, the intake elbow 24 includes a main, downwardly-extending portion 28 that extends downward from the air filter cavity 17 and a further, horizontally-oriented end portion 29 connected to the lower end of the portion 28. The end portion 29 terminates in a carburetor mounting face 26 at which the end portion can be coupled to the carburetor by way of a pair of bolts that can be fitted within a pair of bolt holes 27 within the mounting face.

The intake elbow 24 in particular is molded to include first and second channels 30 and 33, respectively (each of which is shown in phantom), by which the carburetor is in communication with the air filter cavity 17 when the carburetor is attached to the mounting face 26. The first channel 30 is connected to (and indeed comprises the inner channel within)

the base tube 18 of FIG. 1 and extends from the air filter cavity down 17 to a first orifice 32 formed on the carburetor mounting face 26. The second channel 33 in contrast links the bottom of the air filter cavity 17 with a second orifice 34 formed on the carburetor mounting face 26. As shown, the first channel 30 and first orifice 32 are respectively of smaller diameter than the second channel 33 and second orifice 34, respectively. This is because, while the second channel and orifice 33, 34 form the primary engine air intake passage leading to the carburetor and are sized appropriately to allow sufficient airflow to the carburetor (and engine), the first channel and orifice 30, 32 instead serve different purpose(s) depending upon the embodiment, application or operational circumstance. More particularly, as will be described in further detail below, the first channel and orifice 30, 32 can serve as one or both of a passageway connecting a carburetor fuel bowl with a primer assembly and bulb, and/or a vent passageway by which fuel vapors within the carburetor fuel bowl are eliminated.

Figure 3A:
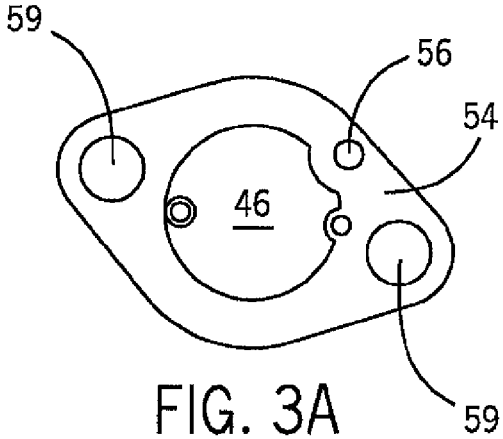
FIG. 3A shows an elevation view of a mounting face of a carburetor of the carburetor assembly of FIG. 3, taken along A-A of FIG. 3.

Turning to FIG. 3, the intake base 2 is shown to be assembled to both a winter intake cover 40 and a carburetor assembly 42, all of which are shown in cross-section. The carburetor assembly 42 includes a carburetor body 44 having an air-fuel mixing chamber 46 (shown in phantom) with a narrow throat or "venturi" region 47. A mounting face 54 of the carburetor body 44 is mounted indirectly upon the carburetor mounting face 26 of the intake base 2 by way of a gasket 49 positioned in between the two mounting faces. The mounting face 54 is shown in more detail in FIG. 3A, which is a side-elevation view of the mounting face taken along line A-A of FIG. 3. As shown in FIG. 3A, the mounting face 54 not only includes the air-fuel mixing chamber 46 but also includes a pair of bolt holes 59 capable of receiving the pair of bolts mentioned above, by which the mounting face 54 is secured to the carburetor mounting face 26 of the intake base 2 (with the gasket 49 therebetween). In alternate embodiments, the mounting faces 54 and 26 can directly interface and contact one another rather than indirectly interface one another by way of a gasket as shown in the present embodiment.

Further as shown in FIG. 3, the carburetor assembly 42 also includes a fuel bowl 48 secured beneath (and possibly integrally formed with) the carburetor body 44. The fuel bowl, which typically contains fuel 61 provided from a fuel tank (not shown), is capable of supplying fuel to the air-fuel mixing chamber 46 within the carburetor body 44 by way of a valve 50 (or other passageway). Additionally, the carburetor body includes a tube 52 that links the fuel bowl 48 to a third orifice 56 on the carburetor mounting face 54 (see also FIG. 3A). When the mounting face 54 of the carburetor assembly 42 is coupled to the carburetor mounting face 26 of the intake base 2, the third orifice 56 is aligned with the first orifice 32, while the air-fuel mixing chamber 46 is aligned with the second orifice 34. Although not shown, it will be understood that the gasket 49 between the mounting faces 26, 54 likewise has a pair of orifices corresponding to the orifices 32, 56 and to the second orifice 34 (and chamber 46), respectively. Consequently, when the carburetor assembly 42 is coupled to the intake base 2, a first sealed passageway links the base tube 18 to the fuel bowl 48, and a second sealed passageway that is the main engine air intake passageway for the carburetor links the bottom of the air filter cavity 17 to the air-fuel mixing chamber 46.

Generally speaking, during engine operation, air enters the air-fuel mixing chamber 46 from the air filter cavity 17 by way of the second channel 33, the second orifice 34 and the corresponding hole through the gasket 49. The venturi region 47 of the air-fuel mixing chamber 46 is at a sub-atmospheric pressure, while the fuel 61 within the fuel bowl 48 is at or close to atmospheric pressure, such that fuel is drawn from the fuel bowl 48 through the valve 50 into the venturi region 47. Upon entering the venturi region 47, the fuel is mixed with the air flowing therethrough, and the mixture then proceeds out of the carburetor body 44 and toward the cylinder(s) of the engine (not shown) with which the intake base 2 and carburetor assembly 42 are associated.

However, at times when the engine is cold or has not been operated for a long period (e.g., during or after the winter season when the temperatures outside are low), the engine is difficult to start initially. To enhance engine performance during such operational circumstances, FIG. 3 shows the intake base 2 to have mounted thereon the winter intake cover 40 having priming system components (described in further detail below), where the combination of the intake base, the carburetor assembly 42 and the winter intake cover together serves as a winter intake assembly 1. In the present embodiment, the winter intake cover 40 is made of molded plastic albeit, in other embodiments, it can be made of other rigid or semi-rigid materials as well.

As shown in FIG. 3, the winter intake cover 40 is designed to be coupled to the upper plate 3 and to be sealed thereto via the lips 2, 4, 6 and 10, such that a cover cavity is formed within the cover between the plate and the cover. As additionally shown in FIG. 4, which provides a top plan view of the winter intake cover 40, the winter intake cover is configured to receive air into the cover cavity formed by the plate 3 and the cover by way of an intake port 76 (in this embodiment, the summer intake tubes 20 do not lead into the cover cavity and are not used). This air is then directed, within the cavity, to the air filter cavity 17 and subsequently by way of the second channel 33 and second orifice 34 into the air-fuel mixing chamber 46 of the carburetor assembly 42.

Figure 4:
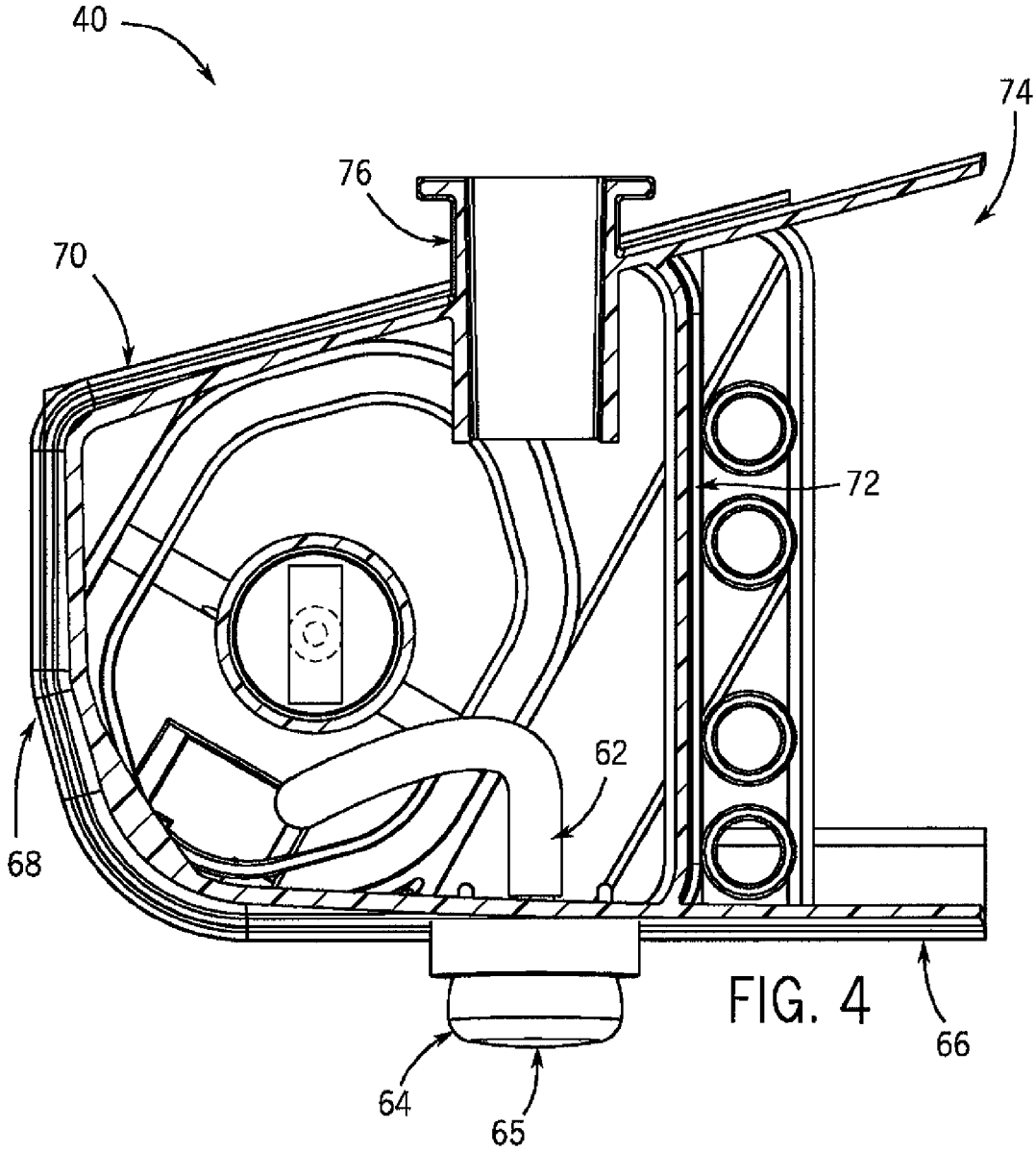
FIG. 4 is a cross-sectional view of the combination of the winter intake cover, intake base and carburetor assembly of FIG. 3, the cross-section being taken along line 4-4 of FIG. 3 through the winter intake cover.

Further as shown in FIG. 4, which shows another cross-section of the assembly of FIG. 3 taken through the winter intake cover 40, the first, second and third walls 66, 68 and 70 of the winter intake cover 40 extend downwardly from a ceiling 69 (see FIG. 3) of the cover so as to interface the first, second and third lips 4, 6, and 8 of the upper plate 3 when the cover is affixed thereto. Additionally (as shown in phantom), the winter intake cover 40 also includes an inner wall 72 that extends downwardly from the ceiling 69 within the winter intake cover so as to interface the fifth lip 10. In the present embodiment, it is the walls 66, 68, 70, 72 and the ceiling 69 that encase the cover cavity and no additional vertical wall is present further outward from the wall 72 at a location 74, albeit in other embodiments an additional wall can be provided at the location 74 (or at another location). Although in the present embodiment the winter intake cover 40 naturally forms a tight seal with respect to the lips 4, 6, 8 and 10, in other embodiments, the winter intake cover 40 can be secured to the upper plate 3 by way of screws and/or bolts or possibly a combination of both (or by way of possibly other types of fasteners).

To provide a priming function, the winter intake cover 40 also includes a priming bulb 64 and an L-shaped priming tube 62 (typically a flexible tube) that extends horizontally inward into the intake cover away from the priming bulb and subsequently downward toward the base tube 18. A lower end of the L-shaped priming tube 62 (again typically a flexible tube) is linked to the base tube 18 when the winter intake cover 40 is attached to the upper plate 3 of the intake base 2, such that the priming bulb 64 therefore also is linked to the base tube 18. The priming bulb 64 can be a conventional flexible (e.g., rubberized) bulb that, upon being deformed, attempts to return to its normal bulbous shape. The priming tube 62 and the base tube 18 preferably are designed so that the tubes can be substantially sealed to one another when the winter intake cover 40 is attached to the upper plate 3, such that a substantially leak-free passageway is formed between the priming bulb and the fuel bowl 48 by way of the tube 52, the channel 30, the base tube 18 and the priming tube 62. Further, the priming bulb 64 has located thereon (e.g., within the middle of the outer surface of the bulb) a small opening/vent 65 via which air from the outside atmosphere can enter the priming bulb.

In alternate embodiments, the base tube 18 can be recessed (or formed as a recess within the floor of the intake base 2) in such a manner that the priming tube 62 can be press fit into a pocket (in which case the priming tube could be of a smaller diameter). Also, while in the present embodiment the priming bulb 64 is connected in a sealed manner to the first wall 66 of the winter intake cover 40 and the priming tube 62 extends from (or is formed entirely as part of) that wall, in other embodiments the priming bulb 64 and priming tube 62 can instead be connected to other walls of the winter intake cover or even mounted on the intake base 2 itself. Further, while in the present embodiment air from the outside atmosphere enters the priming bulb via the opening 65, in other embodiments air from the outside atmosphere can enter the priming bulb in a different manner, for example, by way of an additional channel formed within the winter intake cover 40. In some such embodiments, the priming bulb can be formed to include an internal lip or other formation that seals off of the additional channel when the bulb is pressed.

When the winter intake assembly 1 is employed, typically the engine is primed during (e.g., just prior to) the starting of the engine as follows. First, an operator covers the opening 65 on the priming bulb 64 (e.g., by covering the opening with his or her finger), thereby restricting air flow from the outside atmosphere into the priming bulb 64. Next, the operator depresses and compresses the priming bulb 64, such that air contained within the priming bulb 64 is forced through the priming tube 62 and into the fuel bowl 48 via the base tube 18, the channel 30 and the tube 52 (more particularly, air within the priming bulb and the respective tubes all moves toward the fuel bowl, and some of the air enters the fuel bowl, that is, a priming air pressure pulse is provided from the priming bulb to the fuel bowl). As a result, fuel within the fuel bowl 48 is forced upward through the valve 50 into the venturi region 47 of the carburetor body 44. Releasing of the priming bulb 64 by the operator allows air from the outside atmosphere to again enter the bulb, thus allowing the bulb to return to its original expanded shape without requiring air (or fuel) to be drawn out of the fuel bowl 48 toward the bulb.

Figure 5:
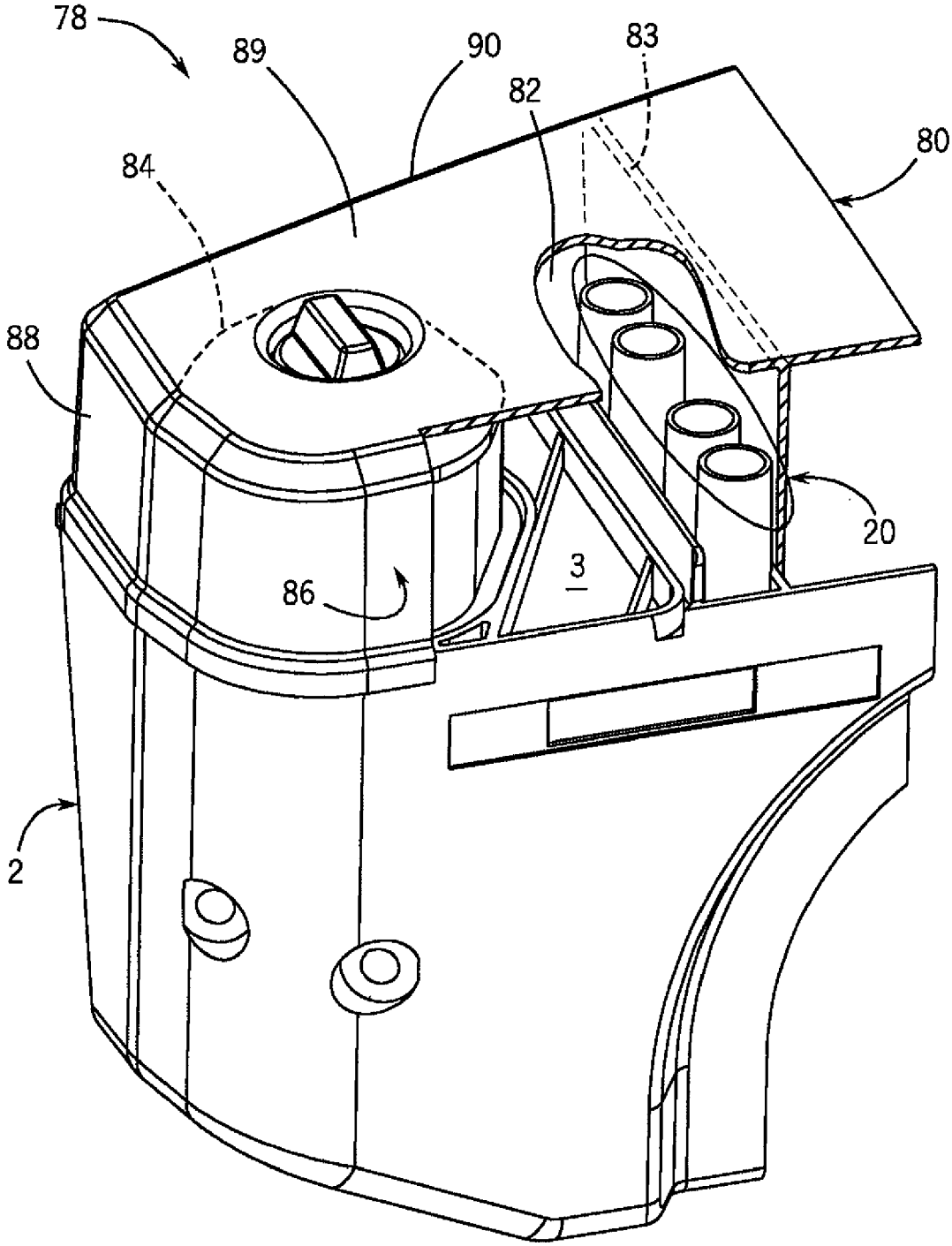
FIG. 5 is a perspective side view of the intake base of FIG. 1 in combination with a summer intake cover, portions of which are shown in cut-away or in phantom, in accordance with another embodiment of the present invention.

In accordance with the present embodiment of the invention, the intake base 2 (and carburetor assembly 42) need not always be implemented in conjunction with the winter intake cover 40 as the winter intake assembly 1. Rather, as shown in FIG. 5 from a side perspective view, in some circumstances the intake base 2 and carburetor assembly 42 instead can be implemented in conjunction with a summer intake cover 80 so as to form a summer intake assembly 78 (the carburetor assembly is hidden in this view). As shown, the summer intake cover 80 is a molded plastic, concave structure that interfaces the lips 4, 6, 8 and 12 of the upper plate 3 of the intake base 2 when installed thereon, such that a plenum or cover cavity 82 is formed between the upper plate and the cover 80 (although not necessarily the case, the summer intake cover 80 as well as the winter intake cover 40 can be made from transparent plastic in some embodiments). Typically the cover cavity 82 is about 4.5 to 5 times the engine displacement in volume, although the ratio can vary considerably depending upon the embodiment.

In contrast to the winter intake cover 40, the summer intake cover 80 only has first, second, third and fourth walls 83, 86, 88 and 90, respectively, that extend downward from a ceiling 89 to the lips 4, 6, 8 and 12 of the upper plate 3 of the intake base 2, and entirely lacks any further wall comparable to the wall 72 that extends downward to the lip 10 of the upper plate 3. It will be understood that, for clarity of presentation, a portion of the second wall 86 is cut-away in FIG. 5 to reveal additional components inside the summer intake cover, and additional components such as the air filter 84 and the first wall 83 are shown in phantom. Consequently, the cover cavity 82 is in communication with the summer intake tubes 20. Further, the summer intake cover 80 lacks an intake port corresponding to the intake port 76 of the winter intake cover 40. Thus, outside atmospheric air is drawn into the cavity 82 by way of the summer intake tubes 20.

Further in contrast to the winter intake cover 40, the summer intake cover 80 lacks any priming bulb or priming tube that can be attached to the base tube 18. No priming mechanism is needed (at least in the present configuration) since, during summer operation, the engine is typically capable of starting adequately without any priming boost (although in alternate embodiments, a priming bulb can be provided on the summer intake cover). Rather, in the present embodiment, the summer intake cover 80 is situated around and encloses an air filter 84 having a largely oval cross-sectional shape that is substantially concentric with respect to the lips 14 and 16 on the upper plate 3 of the intake base 2. More particularly as shown in FIG. 5, the air filter 84 is configured to fit securely upon the upper plate 3 between the lips 14 and 16. When the air filter 84 is mounted onto the upper plate 3, the lips 14, 16 (particularly the lip 16) form a seat with respect to the air filter, such that the air filter cavity 17 is only in communication with the remainder of the cover cavity 82 (and thus the outside atmosphere) via the air filter. Thus, unfiltered air cannot enter the air filter cavity 17 except by way of the filter 84 itself such that the air within the air filter cavity is filtered.

Additionally, when the air filter 84 is mounted onto the upper plate 3, the base tube 18 is located beneath the air filter 84 and is thus shielded from the outside atmosphere and from incoming unfiltered air by the air filter. In this arrangement, although the base tube 18 in combination with the tube 52 and the channel 30 does not serve as part of a priming mechanism, the base tube along with the tube 52 and the channel 30 can instead serve as a bowl vent for the fuel bowl 48. Due to the presence of this bowl vent, pressure changes within the fuel bowl 48 resulting from temperature changes or for other reasons can be accommodated without the injection of fuel into the air-fuel mixing chamber 46. Further, the air filter 84 acts to shield the base tube 18 from the unfiltered air entering the cavity 82, such that any air entering the fuel bowl via the base tube 18, tube 52 and channel 30 is filtered air. Additionally, because of the presence of the air filter 84, any fuel fumes escaping from the fuel bowl 50 via the tube 52, the channel 30 and the base tube 18 do not escape to the atmosphere but rather are contained (or substantially contained) by the air filter 84 (that is, the bowl vent is internal).

Thus, in operation, the summer intake tubes 20 located on the upper plate 3 of the intake base 2 draw in unfiltered air from the atmosphere. That air is then directed within the cavity 82 to the air filter 84, which cleans the air and passes the now-filtered air into the air cavity 17. The filtered air then further proceeds through the second channel 33 to the air-fuel mixing chamber 46 of the carburetor assembly 42. When the engine is not running, vapors from the fuel bowl are vented internally to the air filter cavity 17 beneath the air filter 84. Later, when the engine is running, the vapors (and their residue) captured by the air filter 84 proceed along with the filtered air to the air-fuel mixing chamber 46, and subsequently are consumed by the engine.

While the FIGS. 1-5 described above show an exemplary embodiment of an integrated air intake and primer assembly having winter and summer configurations, the present invention is intended to encompass a variety of alternative embodiments having one or more features differing from those described above. For example, in at least some alternate embodiments, the shapes, sizes and orientations of the various components employed in the winter and summer intake assemblies can vary from those shown in FIGS. 1-5. Also, in some embodiments, there can be more than merely two interchangeable covers, for example, a first, winter intake cover having a primer tube/bulb, a second, summer intake cover not having any primer tube or bulb, and a third, summer intake cover having a primer tube/bulb.

Also, in some alternate embodiments, the priming mechanism of the winter configuration can be configured so that air entering the priming bulb 64 is not merely unfiltered air from the outside atmosphere but rather is filtered air. For example, one such embodiment can employ the air filter 84 not merely in the summer intake assembly but also in the winter intake assembly, and further such embodiment can additionally include first and second additional tubes within the winter intake cover and the intake base, respectively, that link the priming bulb to the region underneath the air filter. Further, it should also be mentioned that the use of positional/directional terms herein (e.g., an "upper" plate) is only for convenience and, although the use of such terms can serve as an indication of actual positions relative to the ground in certain embodiments, in other embodiments the positions/directions of the structures relative to the ground or any other reference point can take other forms.

It should be evident from the above description that at least some embodiments of the present invention are advantageous insofar as they allow for the integration of a priming mechanism with one or more air intake components of an engine. In at least some such embodiments, an air intake structure leading to the carburetor includes not only a passageway for communicating air to the engine, but also further includes an additional passageway that is capable of linking a priming bulb mounted on the air intake structure (or on an additional structure coupled to the air intake structure) to a channel within the carburetor leading to the fuel bowl. In such embodiments, the priming mechanism can be coupled to the fuel bowl without any primer fitting, and the presence of the priming mechanism allows for enhanced start up operation of the engine (for example, during wintertime operation), without tampering with or changing any parts of either the combustion engine or the carburetor.

Additionally, in at least some embodiments, the air intake structure can encompass multiple interchangeable portions, such that in some circumstances the additional passageway leads to a priming bulb mounted on the air intake structure, while in other circumstances the additional passageway only serves as a venting passageway to allow venting of fuel vapors from the fuel bowl to another location such as a cavity downstream of an air filter. Further, in at least some such embodiments, the air intake structure includes two (or possibly more) substitutable covers or other components allowing the air intake structure to take different forms suitable for different operating conditions, such as a first winter configuration and a second summer configuration. Thus, while in one form the air intake structure allows for priming of the engine, in another form the air intake structure allows for the fuel bowl to internally vent without changing the carburetor or the portion of the air intake structure that is coupled to the carburetor.

It is specifically intended that the present invention not be limited to the embodiments and illustrations contained herein, but include modified forms of those embodiments including portions of the embodiments and combinations of elements of different embodiments as come within the scope of the following claims.

We claim:

1. An air intake component comprising:

a surface capable of being coupled at least indirectly to a carburetor assembly, wherein the surface includes first and second orifices;

a first channel capable of communicating engine intake air from a first location to the first orifice of the surface, and a second channel by which at least one of the first location and a second location is connected to the second orifice, wherein the second channel is capable of communicating at least one of a primer air pressure pulse from the at least one location to the second orifice and fuel fumes from the second orifice to the at least one location.

2. The air intake component of claim 1, wherein the air intake component is an air intake base having a first portion that includes a mounting plate and a second portion that extends outward away from the mounting plate.

3. The air intake component of claim 2, wherein the first and second channels lead from the first portion through the second portion and up to the surface, which is formed on the second portion.

4. The air intake component of claim 3, wherein the mounting plate includes at least one lip that is configured to interface an air filter device.

5. The air intake component of claim 4, wherein a cavity is formed within the first portion that extends toward the second portion, and wherein the cavity is covered by the air filter device when the air filter device is mounted onto the mounting plate.

6. The air intake component of claim 5, wherein the first and second channels respectively link the first and second orifices with the cavity, and wherein the second portion includes an elbow-shaped feature.

7. The air intake component of claim 2, wherein the mounting plate includes a plurality of lips by which at least one cover can be attached to the mounting plate.

8. An air intake assembly comprising the air intake component of claim 1 and further comprising a first cover that is coupled to the air intake component.

9. The air intake assembly of claim 8, wherein the air intake component is configured to allow a plurality of interchangeable covers including the first cover to be attached to the air intake component.

10. The air intake assembly of claim 9, wherein the plurality of interchangeable covers includes a first cover that is suited for winter operation, and a second cover that is suited for summer operation.

11. The air intake assembly of claim 8, wherein the cover includes a priming bulb and an additional channel extending from the priming bulb to an end portion and wherein, upon assembling of the cover to the air intake assembly, the end portion of the additional channel is interconnected with the second channel.

12. The air intake assembly of claim 11, further comprising the carburetor assembly, wherein the carburetor assembly includes a fuel bowl and a passage extending from the fuel bowl and wherein, when the carburetor assembly is at least indirectly coupled to the surface, the passage is in communication with the second channel.

13. The air intake assembly of claim 12, wherein a compressing of the priming bulb results in the primer air pressure pulse being communicated to the second orifice and subsequently toward the fuel bowl via the passage, which in turn results in an injection of fuel from the fuel bowl into an air-fuel mixing chamber of the carburetor assembly.

14. The air intake assembly of claim 12, wherein the surface is coupled to the carburetor assembly by way of a plurality of bolts and a gasket positioned in between the surface and the carburetor assembly.

15. The air intake assembly of claim 8, further comprising an air filter device that is supported upon the mounting plate within an internal region formed by the cover and the mounting plate, wherein the air filter device divides the internal region into a first cavity and a second cavity, and wherein unfiltered air entering the first cavity proceeds to become filtered air within the second cavity as the unfiltered air passes through the air filter device.

16. The air intake assembly of claim 15, further comprising the carburetor assembly, wherein the carburetor assembly includes a fuel bowl and a passage extending from the fuel bowl and wherein, when the carburetor assembly is at least indirectly coupled to the surface, the passage is in communication with the second channel.

17. The air intake assembly of claim 16, wherein each of the first and second channels is connected to a respective position within the second cavity, wherein the fuel fumes emanate from the fuel bowl to the second cavity via the second channel, and wherein the fuel fumes are at least substantially contained within the second cavity due to the air filter device.

18. The air intake component of claim 1, wherein the air intake component is formed from molded plastic.

19. An air intake assembly including the carburetor assembly of claim 17, further comprising at least one air intake component that is coupled at least indirectly to the surface.

20. The air intake assembly of claim 19, wherein the at least one air intake component includes an intake base and a cover that is mounted upon the intake base.

21. The air intake assembly of claim 20, wherein the first and second orifices are coupled to at least one region within at least one of the intake base and the cover by way of first and second channels formed within the intake base, respectively.

22. The air intake assembly of claim 21, further comprising means for filtering mounted upon the intake base and within the cover, wherein the means for filtering separates a first of the at least one region from a second of the at least one region, wherein unfiltered air enters the air intake assembly at the first region, and wherein the first and second channels are each connected to the second region.

23. The air intake assembly of claim 22, wherein fuel fumes from the fuel bowl proceeding by way of the further passage, the second orifice, and the second channel to the second region are substantially contained by the means for filtering.

24. The air intake assembly of claim carburetor assembly of claim 17, wherein at least one of the intake base and the cover includes a priming actuator, and wherein the second orifice and further passage allow a priming pulse originating at the priming actuator to be delivered to the fuel bowl.

25. An air intake assembly comprising:

a first portion having a first surface; and a cover that is assembled to the first portion along a second surface, wherein the first portion includes first and second channels linking a first region formed by the first portion and the cover to the first surface, wherein the first channel serves as a passage for engine intake air to be communicated to a carburetor, while the second channel serves to allow communication of at least one of a priming impulse and fuel vapors.

26. The air intake assembly of claim 25, wherein the cover includes at least one of:

a winter intake cover having a priming bulb and a priming tube capable of being coupled to the second channel when the winter intake cover is assembled to the first portion; and a summer intake cover.

27. The air intake assembly of claim 25, further comprising an air filter mounted upon the second surface, wherein the first region is formed in between the air filter and the first portion.

* * * * *

UNITED STATES PATENT AND TRADEMARK OFFICE

CERTIFICATE OF CORRECTION

PATENT NO. : 7,845,623 B2
APPLICATION NO. : 12/018001
DATED : December 7, 2010
INVENTOR(S) : Russell J. Dopke et al.

It is certified that error appears in the above-identified patent and that said Letters Patent is hereby corrected as shown below:

The columns and line numbers where the errors occur in the issued patent are as follows:

Column 8, line 34: Replace “seat,” with --seal,--.

Signed and Sealed this
Twenty-second Day of February, 2011

David J. Kappos

David J. Kappos
*Director of the United States Patent and Trademark Office*